US010299975B2

(12) United States Patent
Sayed

(10) Patent No.: US 10,299,975 B2
(45) Date of Patent: May 28, 2019

(54) WHEELCHAIR MOUNTING SYSTEMS AND METHODS OF USING THE SAME

(71) Applicant: Mohammad Sayed, Watertown, MA (US)

(72) Inventor: Mohammad Sayed, Watertown, MA (US)

( * ) Notice: Subject to any disclaimer, the term of this patent is extended or adjusted under 35 U.S.C. 154(b) by 174 days.

(21) Appl. No.: 15/344,437

(22) Filed: Nov. 4, 2016

(65) Prior Publication Data

US 2017/0127842 A1 May 11, 2017

Related U.S. Application Data

(60) Provisional application No. 62/366,962, filed on Jul. 26, 2016, provisional application No. 62/251,785, filed on Nov. 6, 2015.

(51) Int. Cl.
*A61G 5/12* (2006.01)
*A61G 5/10* (2006.01)

(52) U.S. Cl.
CPC ..... *A61G 5/128* (2016.11); *A61G 5/10* (2013.01); *A61G 5/1094* (2016.11)

(58) Field of Classification Search
None
See application file for complete search history.

(56) References Cited

U.S. PATENT DOCUMENTS 4,979,534 A 12/1990 Johnson
4,989,836 A * 2/1991 Hudson, III ..... A47C 7/383 297/391
5,065,779 A 11/1991 Johnson
5,176,259 A * 1/1993 Andersen ..... A47B 23/02 206/557
5,368,055 A 11/1994 Johnson
5,487,401 A 1/1996 Johnson
9,939,138 B2 * 4/2018 Pierre ..... F21V 21/145
(Continued)

OTHER PUBLICATIONS

Gustbuster Ltd.; Webpages of "The Gustbuster—The World's Smartest Umbrella"; retrieved from <http://www.gustbuster.com/> and <http://www.gustbuster.com/products.html> on Jan. 19, 2017 (5 pages).

(Continued)

*Primary Examiner* — David E Allred
(74) *Attorney, Agent, or Firm* — Nixon Peabody LLP

(57) ABSTRACT

A system includes an adapter and a lock. The adapter includes a flexible collar and an attachment structure. The flexible collar is configured to at least partially surround a portion of the wheelchair such that the flexible collar engages the portion of the wheelchair and aids in preventing rotation of the adapter relative to the portion of the wheelchair. The attachment structure has a first arm attached to and extending from the flexible collar and a second arm attached to and extending from the flexible collar. The lock includes a body and a mounting platform attached thereto. The body of the lock is configured to engage the attachment structure to aid in maintaining the flexible collar in a closed position. The mounting platform has one or more coupling mechanisms attached thereto for use in removably mounting one or more accessories to the system.

18 Claims, 15 Drawing Sheets

(56) References Cited

U.S. PATENT DOCUMENTS

| | | | | |
|---|---|---|---|---|
| 2012/0091765 | A1* | 4/2012 | Carroll | A47C 7/62<br>297/188.11 |
| 2013/0020783 | A1* | 1/2013 | Samila | A61G 5/10<br>280/304.1 |
| 2016/0243597 | A1* | 8/2016 | Shawver | F28G 15/02 |

OTHER PUBLICATIONS

1800Wheelchair.com; Webpage of "Ada-Lap Base Unit"; retrieved from <http://www.1800wheelchair.com/product/ada-lap-base-unit/> on Jan. 19, 2017 (4 pages).
1800Wheelchair.com; Webpage of "Wheelchair Umbrella"; retrieved from <http://www.1800wheelchair.com/product/wheelchair-umbrella/> on Jan. 23, 2017 (5 pages).
1800Wheelchair.com; Webpage of "Phone Holder with Mounting Clamp"; retrieved from <http://www.1800wheelchair.com/product/phone-holder-with-mounting-clamp/> on Jan. 23, 2017 (5 pages).
1800Wheelchair.com; Webpage of "Ram Adjustable Mounting Arm"; retrieved from <http://www.1800wheelchair.com/product/ram-adjustable-mounting-arm/> on Jan. 23, 2017 (4 pages).
1800Wheelchair.com; Webpage of "Life Mounts Led Light with Universal Mount"; retrieved from <http://www.1800wheelchair.com/product/life-mounts-led-wheelchair-walker-light-with-universal-mount/> on Jan. 23, 2017 (5 pages).
1800Wheelchair.com; Webpage of "Wheelchair Fishing Pole Holder"; retrieved from <http://www.1800wheelchair.com/product/wheelchair-fishing-pole-holder> on Jan. 23, 2017 (5 pages).

* cited by examiner

WHEELCHAIR MOUNTING SYSTEMS AND METHODS OF USING THE SAME

CROSS-REFERENCE TO RELATED APPLICATIONS

This application claims the benefit of U.S. Provisional Application No. 62/251,785, filed Nov. 6, 2015, and U.S. Provisional Application No. 62/366,962, filed Jul. 26, 2016, each of which is hereby incorporated by reference herein in its entirety.

TECHNICAL FIELD

The present disclosure relates generally to systems and methods for attaching items to a wheelchair and, more particularly, to a height-adjustable system for attaching items to the footrest of a wheelchair.

BACKGROUND

Users of wheelchairs often have need of items to assist them in their daily lives. Many of these items come in the form of attachments for the wheelchair that allow them to carry common items, such as umbrellas, mobile phones, plates, cups, etc. Often, these attachments were designed to be attached to the wheelchair in inconvenient locations, such as behind the wheelchair or to the tubes near the front wheels. These locations make it difficult for the user to control or access the item attached to the wheelchair, and these systems were often very intrusive. Thus, new systems for mounting items to a wheelchair are needed. The present disclosure addresses these and other problems.

SUMMARY

According to some implementations of the present disclosure, a system for removably mounting accessories to a wheelchair includes an adapter and a lock. The adapter includes a flexible collar and an attachment structure. The flexible collar is configured to move between an open position and a closed position. The flexible collar is configured to at least partially surround a portion of the wheelchair such that the flexible collar engages the portion of the wheelchair and aids in preventing rotation of the adapter relative to the portion of the wheelchair. The attachment structure has a first arm attached to and extending from the flexible collar and a second arm attached to and extending from the flexible collar. The lock includes a body and a mounting platform attached thereto. The body of the lock is configured to engage the attachment structure of the adapter to aid in maintaining the flexible collar in the closed position. The mounting platform has one or more coupling mechanisms attached thereto for use in removably mounting one or more of the accessories to the system.

According to some implementations of the present disclosure, a method for securing an accessory mounting system to a wheelchair includes providing an adapter including a flexible collar and an attachment structure. The flexible collar has an open position and a closed position. The attachment structure has a first arm attached to and extending from the flexible collar and a second arm attached to and extending from the flexible collar. A lock is provided that includes a body and a mounting platform attached thereto. The first arm of the attachment structure is moved relative to the second arm of the attachment structure thereby causing the flexible collar to be in the open position. With the flexible collar positioned adjacent to a portion of the wheelchair, the first arm of the attachment structure is moved relative to the second arm of the attachment structure such that (i) the first arm is directly adjacent to the second arm and (ii) the flexible collar is in the closed position. With the flexible collar in the closed position, the lock is coupled to the attachment structure such that the body of the lock engages at least a portion of the attachment structure, thereby aiding in maintaining the flexible collar in the closed position.

According to some implementations of the present disclosure, a canopy system for use with a wheelchair includes an adapter, a lock, and a canopy support. The adapter includes a flexible collar and an attachment structure. The flexible collar is configured to move between an open position and a closed position. The flexible collar is configured to at least partially surround an arm rest of the wheelchair to aid in preventing rotation of the adapter relative to the arm rest. The attachment structure has a first arm attached to and extending from the flexible collar and a second arm attached to and extending from the flexible collar. The adapter is configured to be coupled to a distal portion of the arm rest of the wheelchair, thereby defining a space between the adapter and a rear-seat portion of the wheelchair to provide a user of the wheelchair direct access to a rear wheel of the wheelchair during operation of the wheelchair. The lock includes a body and a gear assembly attached thereto. The body of the lock is configured to engage the attachment structure of the adapter to aid in maintaining the flexible collar in the closed position. The gear assembly has a gear, a gear locking mechanism, and an axel. The gear has a plurality of teeth and an aperture. The plurality of teeth is configured to engage the gear locking mechanism. The aperture of the gear is configured to receive the axel such that the gear is rotatable relative to the axel. The canopy support is attached to and extends from the gear. The canopy support is pivotal with respect to the body of the lock such that a user of the wheelchair can selectively deploy and retract a canopy coupled to the canopy support.

According to some implementations of the present disclosure, a system for removably mounting accessories to a wheelchair includes a baseplate, a first hollow member, a second hollow member, and a locking mechanism. The baseplate is configured to engage a footrest of the wheelchair. The first hollow member is coupled to the baseplate and extends therefrom. The first hollow member has a first plurality of openings positioned along a first side of the first hollow member and a second plurality of openings positioned along a second opposing side of the first hollow member such that each of the first plurality of openings is aligned with a corresponding one of the second plurality of openings. The locking mechanism includes a flexible connector and a pin. The flexible connector has a first end coupled to the pin and a second end terminating in a flexible loop. The pin is configured to be coupled with corresponding ones of the first and the second pluralities of openings to couple the locking mechanism to the first hollow member. The second hollow member is configured to slide over at least a portion of the first hollow member such that (i) a first end of the second hollow member is configured to engage the pin, thereby establishing a relative location of the second hollow member along the first hollow member and (ii) at least a portion of the flexible connector is positioned between the first hollow member and the second hollow member with the flexible loop being accessible through a second opposing end of the second hollow member.

These and other aspects of the present disclosure will become more apparent from the following detailed description of the systems and methods in conjunction with the accompanying drawings.

Figure 1A:
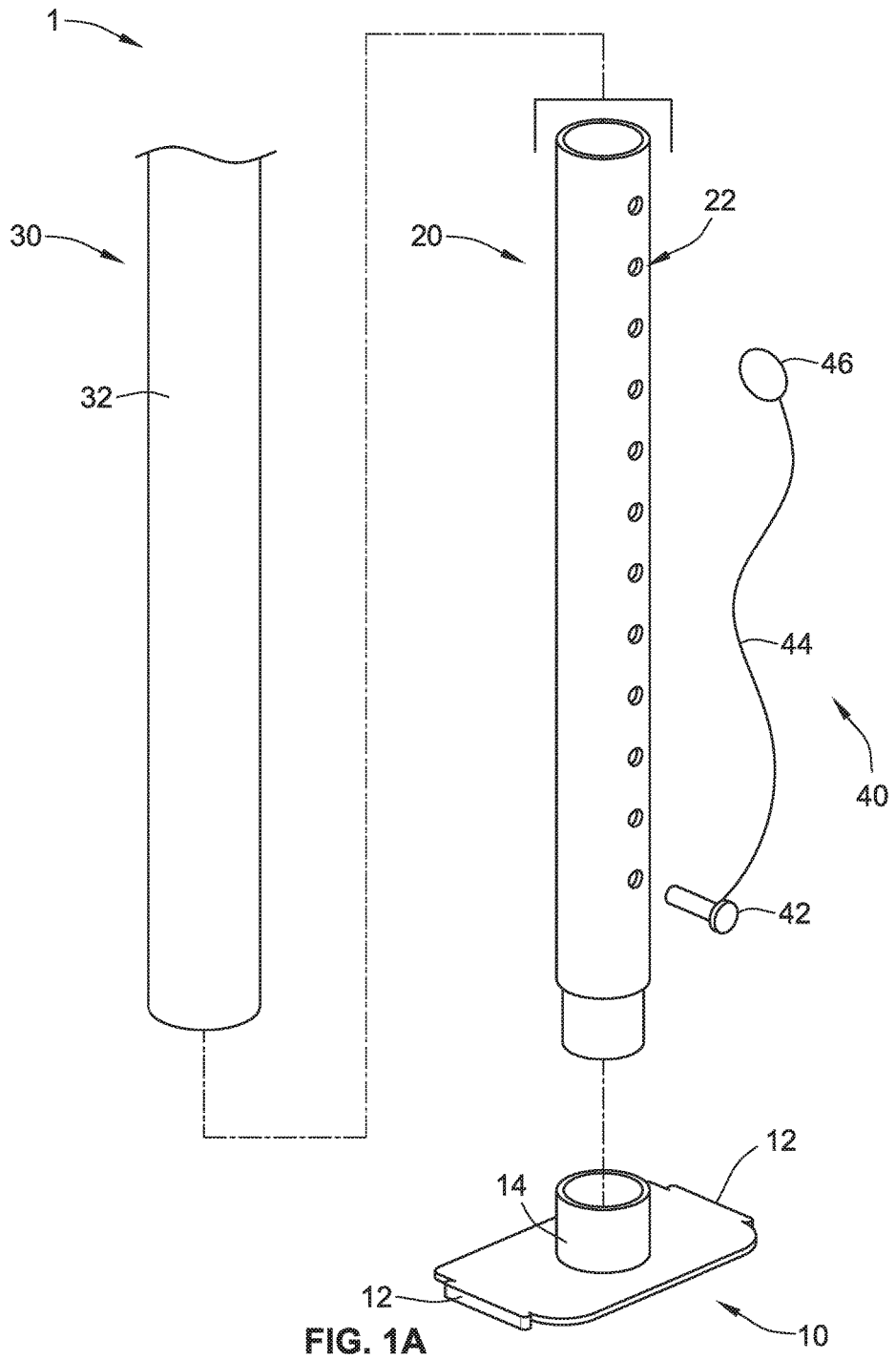
FIG. 1A is an exploded perspective view of an accessory mounting system according to some implementations of the present disclosure.

The present disclosure is susceptible to various modifications and alternative forms, and some representative implementations have been shown by way of example in the drawings and will be described in detail herein. It should be understood, however, that the inventive aspects of the disclosure are not limited to the particular forms disclosed. Rather, the disclosure is to cover all modifications, equivalents, and alternatives falling within the spirit and scope of the invention as defined by the appended claims.

DETAILED DESCRIPTION

The devices, systems, and methods described herein may be utilized to mount accessories to a transportation device (e.g., a wheelchair 50). However, the devices, systems, and methods of the present disclosure can be used with other transportation devices, such as walkers, strollers, bicycles, scooters, Segways®, all-terrain vehicles, skateboards, hoverboards, automobiles, motorcycles, etc. Such accessories may include umbrellas, mobile phone holders, trays, cups, cup-holders, tablet-holders, camera-holders, etc., or the like.

Figure 1B:
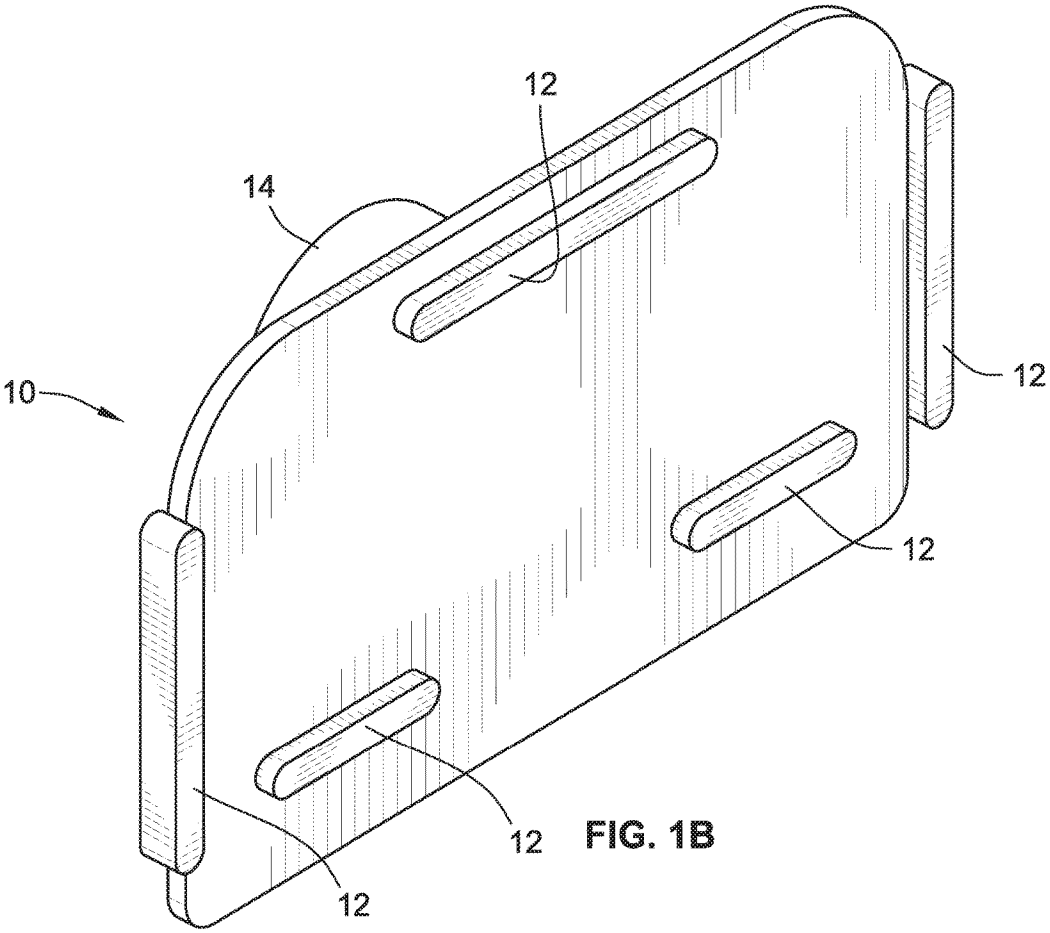
FIG. 1B is a perspective view of a baseplate of the system of FIG. 1A.

Referring to FIG. 1A, an accessory mounting system 1 includes a base plate 10, a first hollow member 20, a second hollow member 30, and a locking mechanism 40. The baseplate 10 is configured for attachment to a wheelchair 50 (FIG. 3) or other transportation device. As best shown in FIG. 1B, the baseplate 10 includes a number of attachment features 12 for aiding in coupling the baseplate 10 to the wheelchair 50. As shown, the attachment features 12 are elongated protrusions that are sized to be inserted into corresponding apertures 52 (FIG. 4) defined in a portion (e.g., footrest 51) of the wheelchair 50. The wheelchair 50, for example, may have the footrest 51 with a number of apertures 52 defined therein (FIG. 4). The attachment features 12 on the baseplate 10 are insertable into the apertures 52 to thereby aid in coupling and/or securing the baseplate 10 to the footrest 51 and thus the wheelchair. Locating the baseplate 10 on the footrest 51 of the wheelchair 50 allows the accessory mounting system 1 to support more weight (e.g., as compared with a system that is manually held by the user/operator of the wheelchair), thereby allowing a user of the wheelchair 50 to improve their experience by carrying more items with them. Furthermore, by locating the baseplate 10 directly on the footrest 51 between the user's legs, the accessory mounting system 1 is less intrusive (e.g., as compared with a system that must be manually held by the user) and does not impede the actions of the user.

Figure 2:
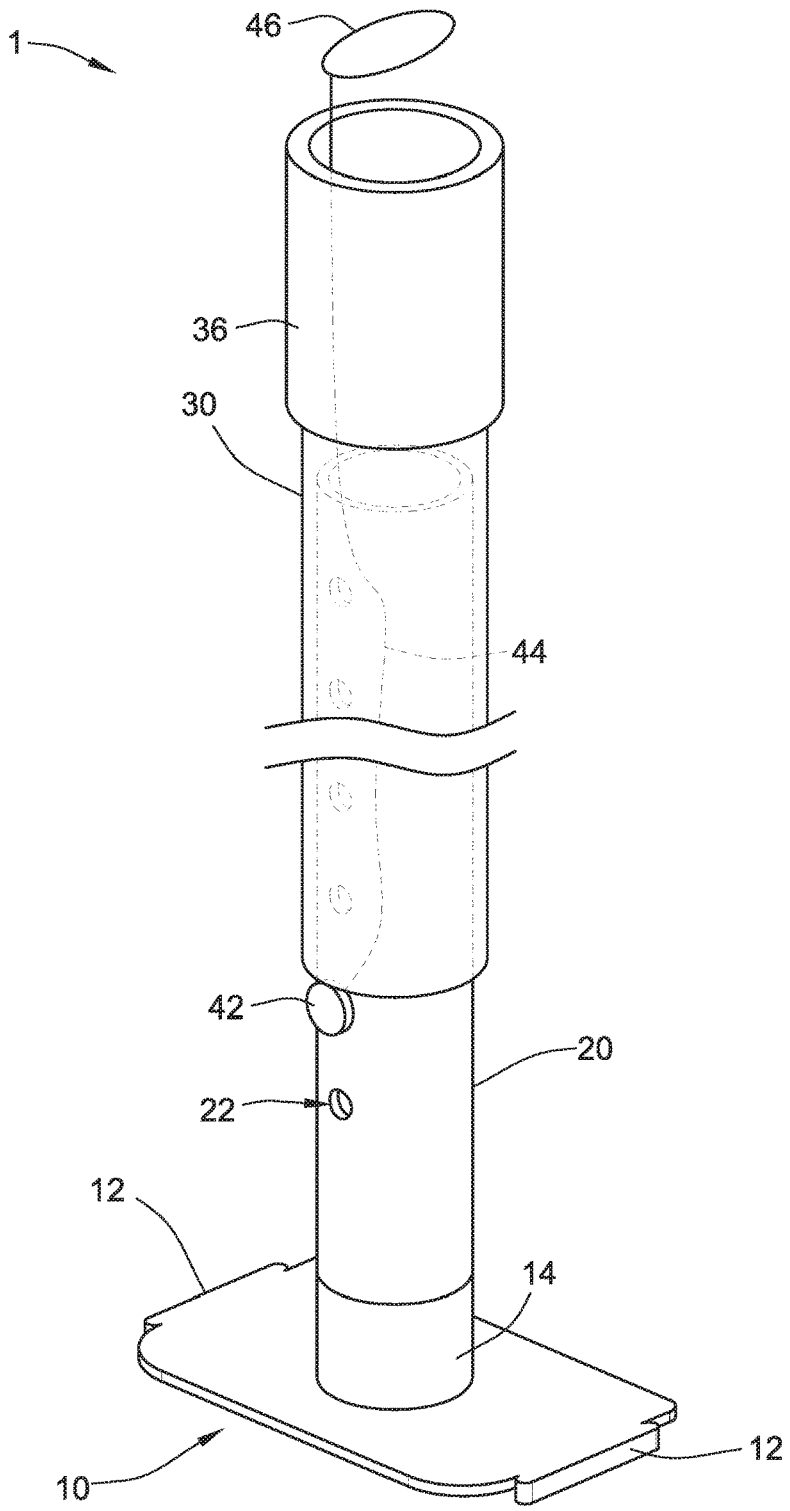
FIG. 2 is an assembled perspective view of the system of FIG. 1A.

As best shown in FIGS. 1A and 2, the baseplate 10 includes a mounting portion 14 for attaching other portions of the accessory mounting system 1. For example, the mounting portion 14 may be an annular projection that allows a similar-shaped component to be inserted therein. The annular projection is generally sized such that a component inserted therein may be secured by friction between the component and the annular projection. However, other possibilities for coupling a component to the mounting portion 14 are contemplated, such as a threaded connection, a welded connection, a pin and aperture system, a locking collar, or tabs.

The first hollow member 20 is coupled and/or secured to the baseplate 10 by the mounting portion 14. For example, the first hollow member 20 may have a generally annular cross-section that is sized to be inserted into the annular shaped mounting portion 14 of the baseplate 10. Once inserted, the first hollow member 20 is generally secured by a friction fit between the first hollow member 20 and the mounting portion 14. Other methods of securing the first hollow member 20 are contemplated as noted above, such as a threaded connection, a welded connection, a pin and aperture system, a locking collar, or tabs designed to be inserted through apertures defined in the first hollow member 20.

As best shown in FIG. 1A, the first hollow member 20 includes a first plurality of openings 22 and a second plurality of openings (not shown) defined therein. The second plurality of openings are generally located 180 degrees along the exterior of the first hollow member 20 away from the first plurality of openings 22, i.e. on an opposing side of the first hollow member 20. In this configuration, each of the first plurality of openings 22 has a corresponding one of the second plurality of openings located on the opposite side of the first hollow member 20 at the same vertical height along the first hollow member 20. Each of the first plurality of openings 22 and each of the second plurality of openings is sized to allow a pin 42 to be inserted therethrough. Thus, the pin 42 extends from a first side of the first hollow member 20, through one of the first plurality of openings 22, through the interior of the first hollow member 20, through the corresponding one of the second plurality of openings, to a second side of the first hollow member 20, where the second side of the first hollow member 20 is located opposite the first side. The first plurality of openings 22 and the second plurality of openings are generally defined in a vertical line along opposing sides of the first hollow member 20. The number of openings within each of the pluralities of openings can vary depending on the height of the first hollow member 20, and thus the desired height of the accessory mounting system 1 as a whole.

The second hollow member 30 of the accessory mounting system 1 has a body portion 32, an upper end, and a lower end. The second hollow member 30 is similarly and/or correspondingly annular-shaped as the first hollow member 20 such that the second hollow member 30 is slidable over and relative to the first hollow member 20. That is, the second hollow member 30 is sized such that it fits over the first hollow member 20. In other words, the outer diameter of the first hollow member 20 is smaller than the inner diameter of the second hollow member 30 so that the first hollow member 20 may be inserted into the second hollow member 30. The inner diameter of the second hollow member 30 is generally large enough such that there is no friction between the first hollow member 20 and the second hollow member 30 and they may slide freely relative to each other when the first hollow member 20 is inserted into the second hollow member 30, or vice versa. The upper end of the second hollow member 30 can include a widened portion 36 (FIGS. 2 and 3) that is generally wider than the body portion 32. The widened portion 36 allows various accessories (e.g., an umbrella) and/or attachments (e.g., lock 250 described below) to be coupled to the accessory mounting system 1.

Both the first hollow member 20 and the second hollow member 30 may generally be approximately forty-four centimeters in height. The first hollow member 20 has an inner diameter of approximately 3.3 centimeters, while the second hollow member 30 has an inner diameter of approximately 3.4 centimeters. The widened portion 36 of the second hollow member 30 comprises the upper five centimeters of second hollow member 30. The inner diameter of the widened portion 36 is approximately 3.5 centimeters. Each of the openings in the first hollow member 20 may have a diameter of approximately 0.8 centimeters. As stated, the first plurality of openings 22 and the second plurality of openings are defined in respective vertical lines along the sides of the first hollow member 20. The openings are spaced approximately five centimeters apart from each other to enable precise height adjustment of the accessory mounting system 1.

As best shown in FIG. 1A, the locking mechanism 40 of the accessory mounting system 1 includes a pin 42 attached to a first end of a flexible connector 44. The flexible connector 44 may be rope, band, cable, wire, twine, or any other suitable material. The other end of the flexible connector 44 terminates in a flexible loop 46. The flexible loop 46 is configured to couple to an umbrella U (FIG. 3) or similar object that may be inserted into the upper end of the second hollow member 30 to thereby secure the umbrella U to the accessory mounting system 1. The pin 42 is inserted into one of the first plurality of openings 22, extends through the interior of the first hollow member 20, and exits out of the other side of the first hollow member 20 through a corresponding one of the second plurality of members. As such, the pin 42 is located to support the second hollow member 30 thereon and establish a height of the accessory mounting system 1. With the pin 42 in place, the second hollow member 30 is slid onto the first hollow member 20 and lowered until the lower end of the second hollow member 30 comes into contact with the pin 42. The second hollow member 30 thus rests on the pin 42 to hold the second hollow member 30 in place. The height of the second hollow member 30 may be adjusted by inserting the pin 42 through a different pair of openings.

As shown in FIG. 1B, the baseplate 10 includes a plurality of attachment features 12 for mating with the footrest 51 of the wheelchair 50. The attachment features 12 extend outwardly from the underside of the baseplate 10. The attachment features 12 are generally sized to "snap" into the apertures 52 (FIG. 4) defined within the footrest 51 of the wheelchair 50 such that the baseplate 10 and the footrest 51 are coupled via a friction fit. While the baseplate 10 is shown as including the elongated protrusions to couple the baseplate 10 to the wheelchair 50, the baseplate 10 can be coupled to the wheelchair 50 by a number of alternative methods. For example, the baseplate 10 can be coupled to the wheelchair 50 via one or more nuts and bolts, one or more screws, a glue connection, a welded connection, a rivet connection, a hinged connection, a pin connection, a hook and loop fastener, one or more magnets, or any combination thereof. In some implementations, the footrest 10 is not coupled to the wheelchair 50 but is merely placed into contact with the footrest 51 and held in place, for example, by an operator stepping on the baseplate 10.

As best shown in FIG. 2, when the accessory mounting system 1 is assembled, the first hollow member 20 is coupled to the mounting portion 14 of the baseplate 10. The second hollow member 30 is placed on the first hollow member 20 with the pin 42 of the locking mechanism 40 inserted through a corresponding pair of the plurality of openings at the desired height. The second hollow member 30 is then lowered onto the pin. Further, the flexible connector 44 is disposed between the first hollow member 20 and the second hollow member 30 such that the loop 46 is accessible and/or at least partially extends out of the upper end of the second hollow member 30 so that it may be readily attached to a handle of the umbrella U. With the pin 42 and the loop 46 so attached (FIG. 3), the locking mechanism 40 aids in keeping the umbrella U in engagement with the accessory mounting system 1.

Figure 3:
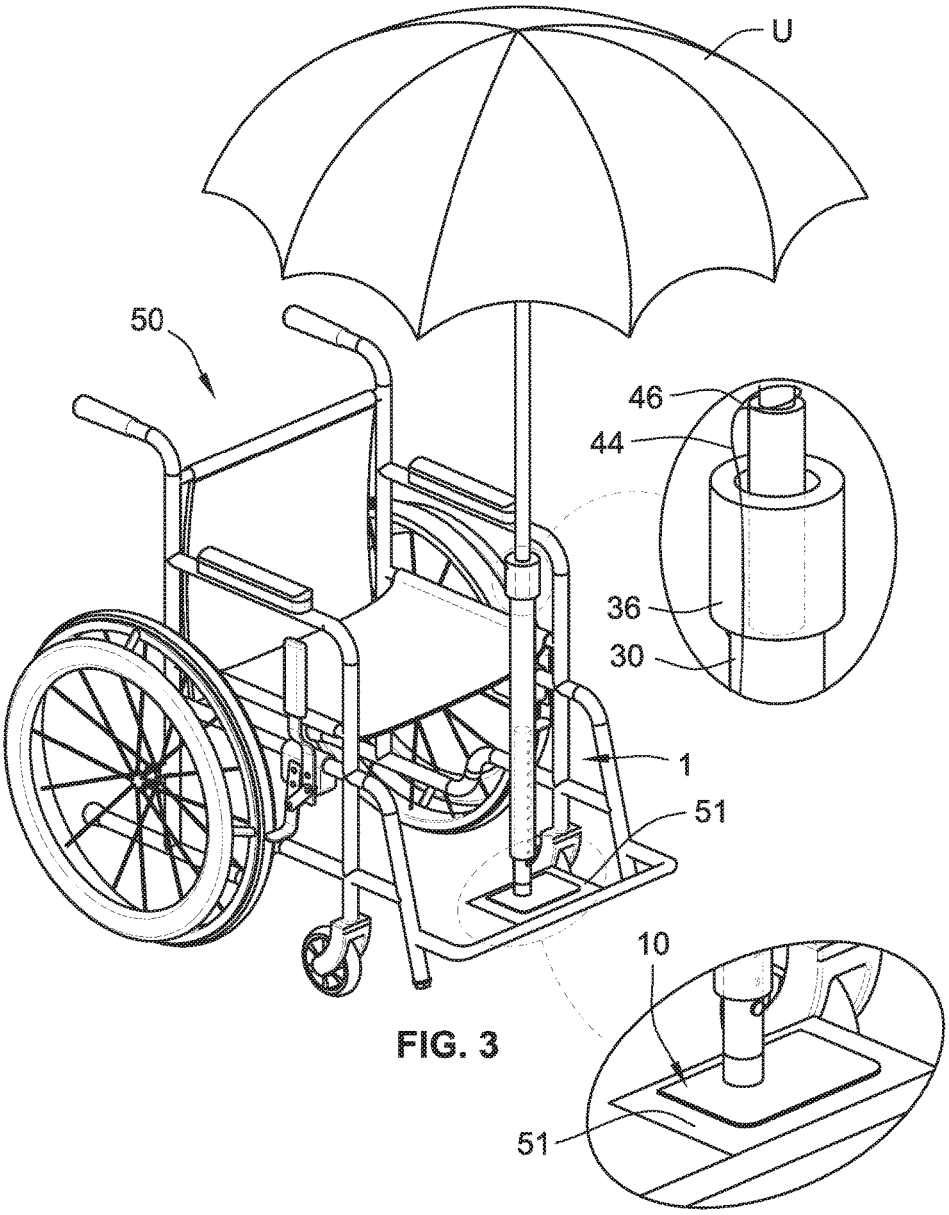
FIG. 3 is an assembled perspective view of the system of FIG. 1A coupled to a wheelchair and supporting an umbrella according to some implementations of the present disclosure.
Figure 4:
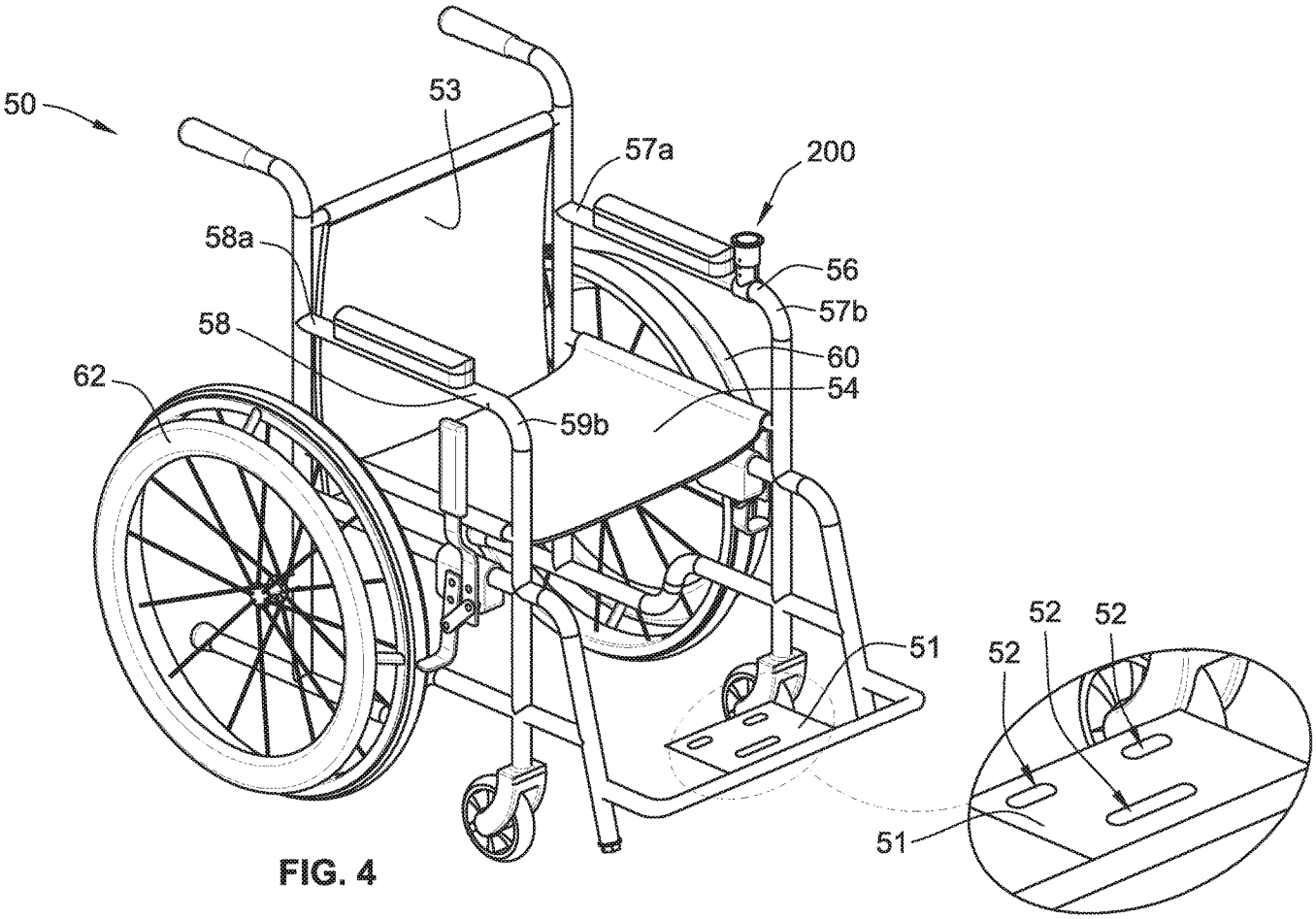
FIG. 4 is a perspective view of an accessory mounting system coupled to a wheelchair according to some implementations of the present disclosure.

Referring to FIG. 3, the accessory mounting system 1 is coupled to the footrest 51 of the wheelchair 50 and holds the umbrella U. The baseplate 10 is coupled to the footrest 51 of the wheelchair 50. The first hollow member 20 is secured to the baseplate 10 while the second hollow member 30 is placed onto the first hollow member 20. The pin 42 is also inserted into one of the first plurality of openings 22 in the first hollow member 20. The lower inset shows a zoomed-in view of the connection between the footrest 51, the baseplate 10, the first hollow member 20, the second hollow member 30, and the pin 42.

Once the components of the accessory mounting system 1 are assembled, the umbrella U may be inserted down into a portion of the interior of the second hollow member 30 and/or of the widened portion 36. The flexible loop 46 of the locking mechanism 40 is sized to engage the handle of the umbrella U and thereby secures the umbrella U to the accessory mounting system 1. As is shown by the top inset, the handle of the umbrella U may be disposed into the second hollow member 30 at a depth substantially equal to the height of the widened portion 36. However, the handle of the umbrella U may be inserted further into the second hollow member 30 to provide increased lateral support to the umbrella U. Generally, the second hollow member 30 can include a structure (not shown) disposed within the interior thereof that supports the handle of the umbrella U such that the umbrella U does not descend too far into the second hollow member 30.

The height of the umbrella U may be adjusted by lifting the umbrella U and the second hollow member 30 and placing the pin 42 through a different pair of openings in the first hollow member 20. This configuration offers certain benefits to the user of the wheelchair 50. The primary benefit is offered by the widened portion 36 of the second hollow member 30, which allows the umbrella U a small amount of room to move within the second hollow member 30. For example, during a strong wind, the umbrella U can move around within the second hollow member 30, thus lessening the force the umbrella U imparts on the wheelchair 50 due to the wind.

The umbrella U can also rotate within the second hollow member 30. For example, if the edge of the umbrella U contacts an obstacle, such as a tree or a hanging sign, due to the configuration of the locking mechanism 40, the umbrella U is free to rotate upon contact instead of getting stuck and pulled out of engagement with the accessory mounting system 1. The rotation makes freeing the umbrella U from the obstacle (e.g., tree branch) much easier, and often allows the user of the wheelchair 50 to continue moving without having to stop to free the umbrella U or specifically move around the obstacle. Moreover, freeing the umbrella U to rotate decreases the chances of the wheelchair 50 being pulled back or even knocked over if the umbrella U comes into contact with an obstacle. Because the handle of the umbrella U is secured to the loop 46 of the locking mechanism 40, there is a reduced/minimal risk that the umbrella U will be inadvertently forced out of the interior of the second hollow member 30 by any external force.

The exemplary placement of the accessory mounting system 1 on the footrest 51 of the wheelchair 50 offers the user a large amount of coverage when the umbrella U is coupled to the accessory mounting system 1, thus protecting the user from rain, snow, sun, etc. Furthermore, locating the umbrella U and the accessory mounting system 1 on the footrest 51 directly in front of the user gives the user more and/or easier control over the accessory mounting system 1, thus improving the user's experience. The umbrella U is also capable of being attached to an extension that hangs down from the edges of the umbrella U, thus providing even more coverage to the user.

In some implementations, the baseplate 10, the first hollow member 20, the second hollow member 30, the flexible connector 44, and any attachments to the accessory mounting system 1 may include a magnetic material to assist in coupling the components together. Alternatively, the components may have a magnet mounted thereon to enable the components to couple with each other, or with accessories. Alternatively, the components of the accessory mounting system 1 may be composed of, for example, aluminum, steel, glass, plastic, or the like. Furthermore, all components of the accessory mounting system 1 may be produced by processes such as 3D printing. Types of 3D printing may include, but are not limited to, fused deposition modeling, stereolithography, selective laser sintering, direct metal laser sintering, selective laser melting, electronic beam melting, laminated object manufacturing, inkjet printing, powder fed directed by energy deposition, continuous liquid interface production, and metal wire processes.

Referring to FIG. 4, an accessory mounting system 200 is attached to the wheelchair 50. As shown, the accessory mounting system 200 is attached to a first arm 56 of the wheelchair 50. In some implementations, the first arm 56 has a diameter of about thirty-three millimeters. While the accessory mounting system 200 is attached to a forward or distal portion of the first arm 56, the accessory mounting system 200 can alternatively be attached to any portion of the first arm 56 between a proximal end 57*a* and a distal end 57*b* of the first arm 56. As such, the user is permitted to customize the positioning of the accessory mounting system 200. Further, attaching the accessory mounting system 200 at either the proximal end 57*a* or distal end 58*a* permits the user to access a first rear wheel 60 and thus freely operate the wheelchair 50 while the accessory mounting system 200 is attached. Alternatively, the accessory mounting system 200 may be attached to any other portion of the wheelchair 50 for use in coupling one or more accessories to the wheelchair to aid in improving a user's experience operating the wheelchair 50.

Figure 5B:
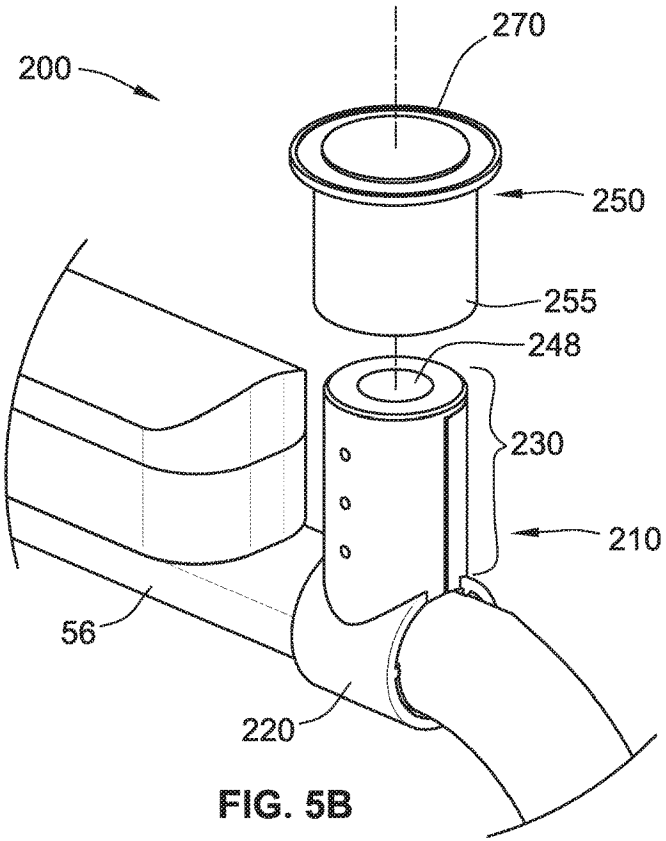
FIG. 5B is a perspective view of the accessory mounting system of FIG. 4 in an unlocked position.
Figure 5A:
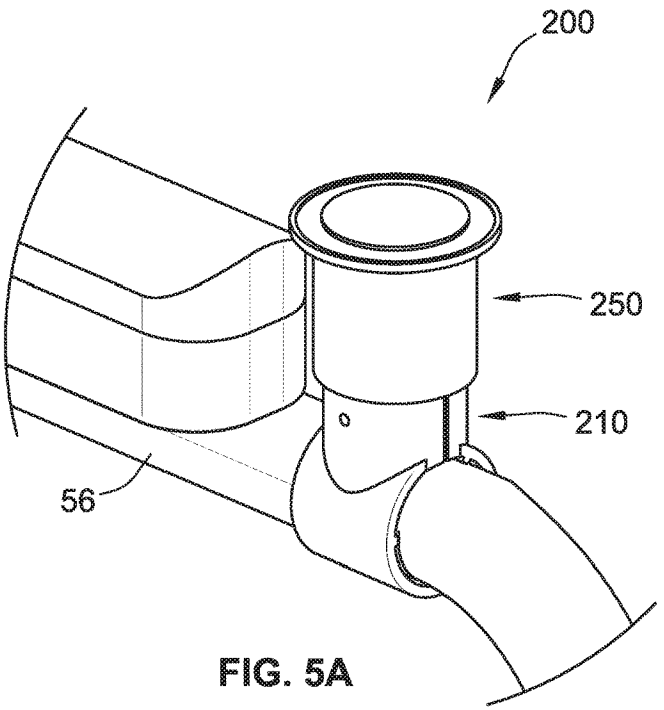
FIG. 5A is a perspective view of the accessory mounting system of FIG. 4 in a locked position.

Referring to FIG. 5A the accessory mounting system 200 includes an adapter 210 and a lock 250. The adapter 210 is attached to the first arm 56 of the wheelchair 50 and the lock 250 is coupled to the adapter 210 such that the accessory mounting system 200 is in a locked and/or installed position. FIG. 5B shows the accessory mounting system 200 with the lock 250 removed from the adapter 210 such that the accessory mounting system 200 is in an unlocked and/or uninstalled position.

Figure 6B:
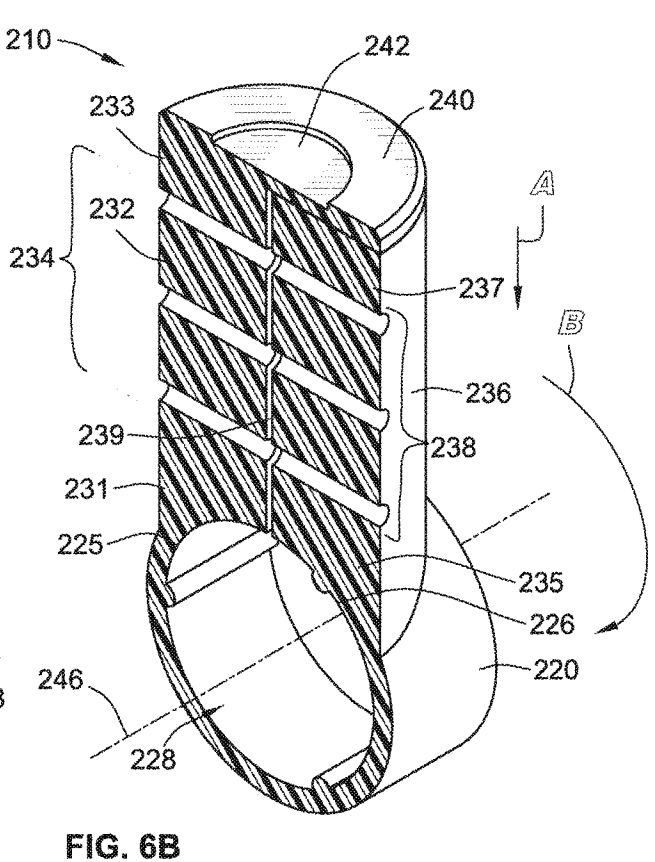
FIG. 6B is a cross-sectional perspective view of the adapter of FIG. 6A.
Figure 6A:
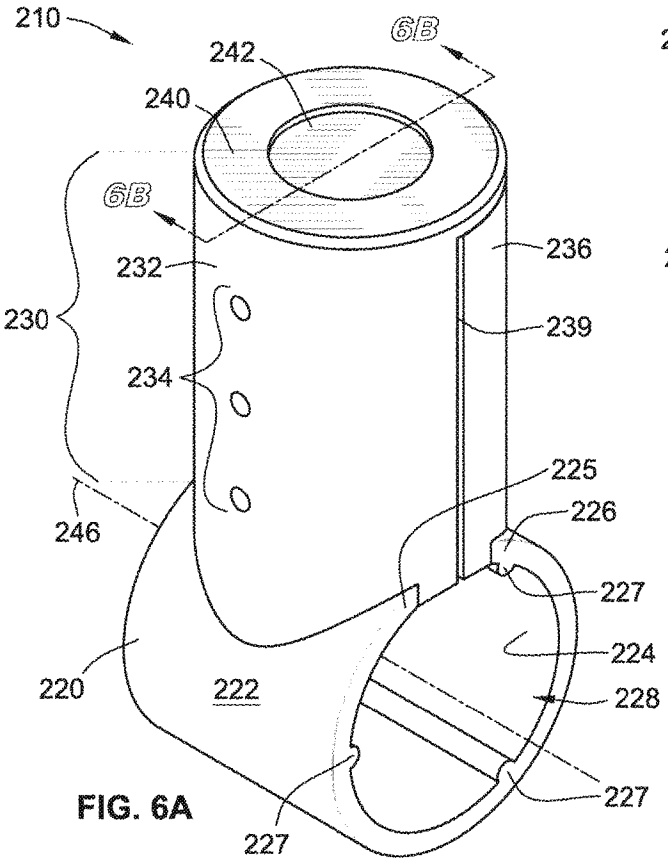
FIG. 6A is a perspective view of an adapter of the accessory mounting system of FIG. 4 in a closed position.
Figure 7:
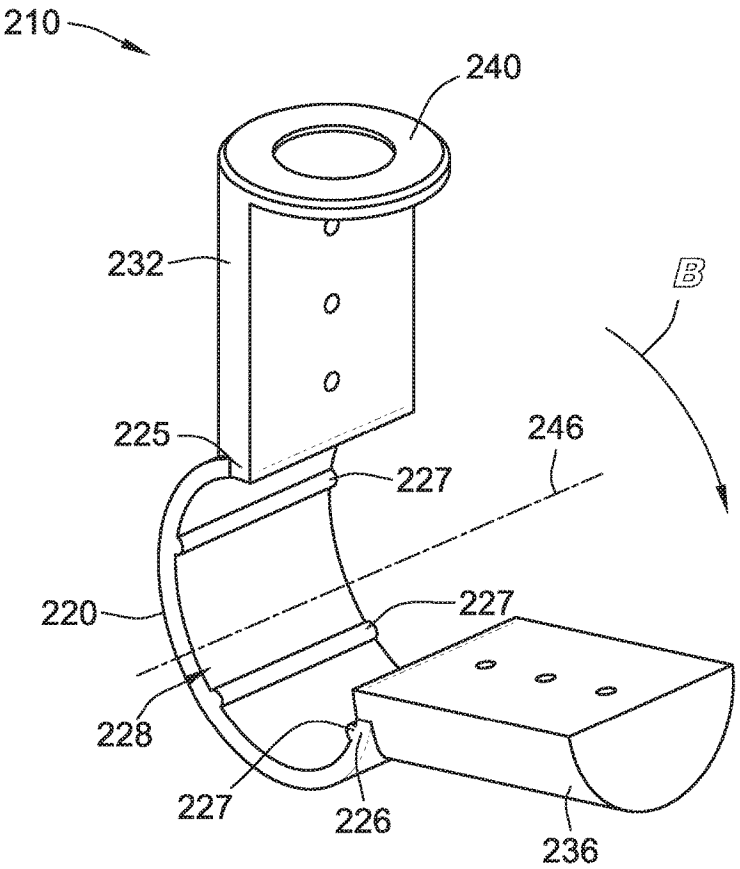
FIG. 7 is a perspective view of the adapter of FIG. 6A in an open position.

Generally referring to FIGS. 6A and 6B, the adapter 210 includes a flexible collar 220 and an attachment structure 230. The flexible collar 220 is configured to at least partially surround a portion (e.g., an arm) of the wheelchair 50. In some implementations, the flexible collar 220 has a diameter of about thirty-three millimeters. The flexible collar 220 may be made of a polymer material, a metal material, a rubber material, or any combination thereof. The adapter 210 is shown in a closed position, which defines an opening 228 of the flexible collar 220. In the closed position, the flexible collar 220 has a generally curved profile. Alternatively, the flexible collar 220 may have a generally rectangular, triangular, and/or polygonal profile to enable the opening 228 to surround various sized and/or shaped portions of the wheelchair 50. While shown in the closed position, in some implementations, the flexible collar 220 is biased to be in a generally open position (FIG. 7).

The flexible collar 220 includes a first end 225 and a second end 227. In the closed position (FIGS. 6A and 6B), the first end 225 is directly adjacent to the second end 227, thereby defining a gap 239. The flexible collar 220 also includes an outer surface 222 and an inner surface 224. As illustrated, the flexible collar 220 has a plurality of ridges 227 protruding from the inner surface 224 into the opening 228. The plurality of ridges 227 are configured to engage the portion (e.g. the arm) of the wheelchair 50 (FIG. 4), thus aiding in preventing the adapter 210 from rotating relative to the portion (e.g., the arm) of the wheelchair 50 coupled thereto. The plurality of ridges 227 generally extend along the inner surface 224 parallel to a central axis 246 of the flexible collar 220.

As best shown in FIG. 6A, the attachment structure 230 has a generally cylindrical configuration. Alternatively, the attachment structure 230 may have any shape configuration, such as, for example, a rectangular configuration, a triangular configuration, a polygonal configuration, etc. The attachment structure 230 includes a first arm 232 and a second arm 236. The first arm 232 has a first end 231 and a second end 233. The first end 231 is coupled to the first end 225 of the flexible collar 220, with the second end 233 extending therefrom. The second arm 236 has a first end 235 and a second end 237. The first end 235 is coupled to the second end 226 of the flexible collar 220, with the second end 237 extending therefrom. As depicted, the first arm 232, the second arm 236, and the flexible collar 220 are unitary and/or monolithic. However, other possibilities for attaching the first arm 232 and second arm 236 to the flexible collar 220 are contemplated, such as a welded connection, an adhesive connection, a pin and aperture system, tabs, or the like. The flexible collar 220 and the attachment structure 230 can be made of the same material and/or a combination of different materials.

The first arm 232 includes a first plurality of apertures 234 and the second arm 236 includes a second plurality of apertures 238. The first plurality of apertures 234 and the second plurality of apertures 238 are generally configured such that the apertures 234, 238 are arranged in a vertical line. In this configuration, each of the first plurality of apertures 234 has a corresponding one of the second plurality of apertures 238 at the same vertical height. As best shown in FIG. 6B, the first plurality of apertures 234 extend through the interior of the first arm 232 to the gap 239 and the second plurality of apertures 238 extend through the second arm 236 to the gap 239. Alternatively, the first plurality of apertures 236 and second plurality of apertures 238 may extend through only a portion of the first arm 232 and second arm 236. While the first plurality of apertures 234 and the second plurality of apertures 238 are each shown as including three apertures, any number of apertures is contemplated, such as, for example, one aperture, two apertures, four apertures, ten apertures, etc.

As shown in FIGS. 6A and 6B, the attachment structure 230 includes an optional plate 240. The plate 240 is attached to the second end 233 of the first arm 232. As shown, the plate 240 and first arm 232 may be unitary and/or monolithic. Alternatively, the plate 240 may be attached to the first arm 232, by welding, an adhesive, a tab, or the like. The plate 240 includes a recess 242 that is configured to receive a first magnet 248 therein (shown in FIG. 5B). As shown, the recess 242 has a generally cylindrical configuration. However, other configurations of the recess 242 are contemplated, including a rectangular configuration, a triangular configuration, and/or a polygonal configuration, which may depend on the size and/or shape of the first magnet 248. The depth of the recess 242 can likewise correspond with a thickness of the first magnet 248.

As best shown in FIG. 7, the second end 237 (FIG. 6B) of the second arm 236 is detached from the plate 240, which allows the second arm 236 to be moved relative to the first arm 232 and relative to the plate 240. As shown in FIGS. 6A and 6B, the second end 237 of the second arm 236 directly abuts the plate 240 when the flexible collar 220 is in the closed position. While the flexible collar 220 is generally biased to move into the open position (FIG. 7), friction between the plate 240 and second end 237 of the attachment arm 236 aids in preventing movement of the second arm 236 relative to the first arm 232 and/or the plate 240. Thus, in some implementations, the plate 240 aids in maintaining the flexible collar 220 in the closed position.

Referring to FIG. 7, the flexible collar 220 is shown in the open position where the first end 225 and the second end 226 of the flexible collar 220 are spaced such that the opening 228 is configured to readily receive the portion (e.g., the arm) of the wheelchair 50 therein. When mounting the adapter 210 to, for example, the first arm 56 of the wheelchair 50, according to some implementations of the present disclosure, the flexible collar 220 is transitioned from the closed position (FIG. 6B) to the open position (FIG. 7) by applying a force to the second arm 236 generally in the direction of Arrow A (FIG. 6B). Moving the second arm 236 in the direction of Arrow A deforms the flexible collar 220 and separates the second end 237 from the plate 240. The second arm 236 may then be rotated in the direction of Arrow B to transition the flexible collar 220 into the open position (FIG. 7). In some of the implementations, the flexible collar 220 can be transitioned into the open position (FIG. 7) by simply applying a force to the second arm 236 in the direction of Arrow B. In this implementation, the force in the direction of Arrow B is sufficient to overcome any friction between the plate 240 and the second end 237 of the second arm 236.

Figure 8B:
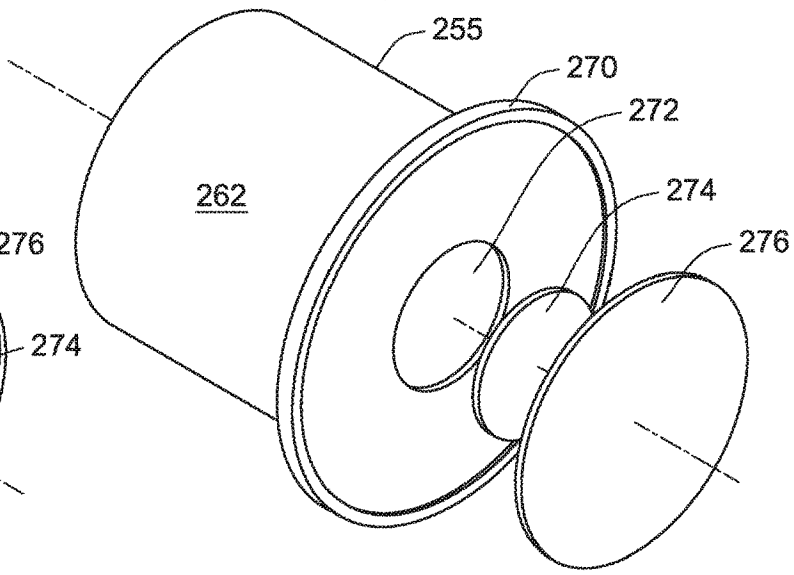
FIG. 8B is another exploded perspective view of the lock of the accessory mounting system of FIG. 4.
Figure 8A:
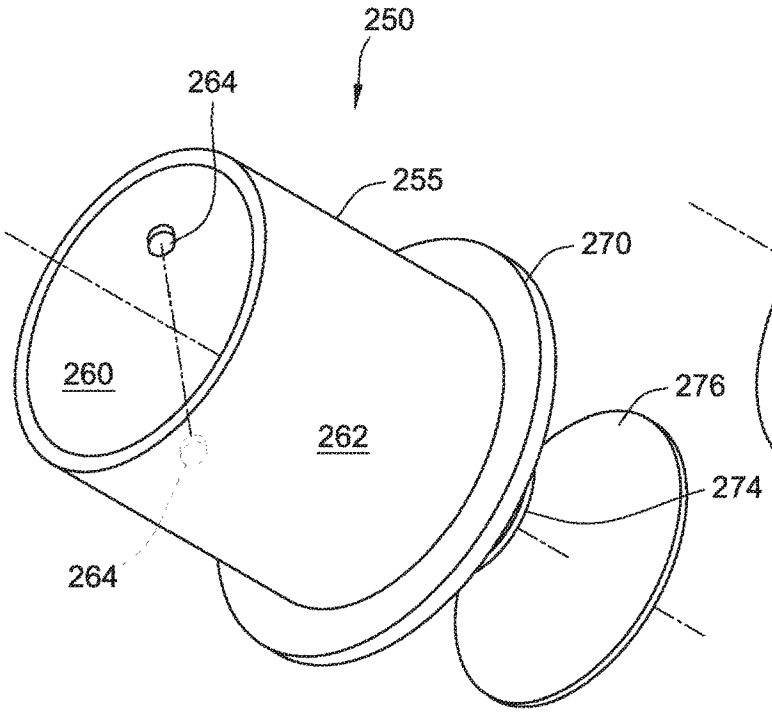
FIG. 8A is an exploded perspective view of a lock of the accessory mounting system of FIG. 4.

Generally referring to FIGS. 8A and 8B, the lock 250 of the accessory mounting system 200 includes a body 255 and a mounting platform 270. The body 255 is sized such that it may fit over the attachment structure 230 of the adapter 210 to maintain the adapter 210 in a locked position. In other words, the inner diameter of the body 255 is larger than the outer diameter of the attachment structure 230. As shown, the body 255 has a generally cylindrical configuration. Alternatively, the body 255 may have any other configuration, such as, for example, a rectangular configuration, a triangular configuration, and/or a polygonal configuration that corresponds to the configuration of the attachment structure 230. The body 255 further includes an inner surface 260 and an outer surface 262. The inner surface 262 includes a pair of protrusions 264 extending inwardly. The pair of protrusions 264 is sized and shaped to engage corresponding ones of the first plurality of apertures 234 and the second plurality of apertures 238 of the attachment structure 230 to aid in holding the lock 250 in engagement with the adapter 210.

As best shown in FIG. 8B, the mounting platform 270 has a generally cylindrical configuration. The diameter of the mounting platform 270 can be sized to accommodate desired accessories to be mounted to the accessory mounting system 200. Alternatively, the mounting platform 270 may have any other shape and/or configuration, such as, for example, a rectangular configuration, a triangular configuration, and/or a polygonal configuration that aids in mounting accessories thereto.

The mounting platform 270 includes one or more coupling mechanisms attached thereto for use in removably mounting one or more accessories to the accessory mounting system 200. As best shown in FIG. 8B, the mounting platform 270 includes a recess 272 that receives a first one of the one or more coupling mechanisms 274. In an exemplary implementation, the first coupling mechanism 274 is a second magnet that is positioned to interact with the first magnet 248 of the adapter 210 (FIG. 5B), thereby aiding in securing the lock 250 to the adapter 210. The first coupling mechanism 274 can also interact with a corresponding magnet of an accessory (e.g., a plate, a camera, etc.), thereby permitting the accessory to be removably mounted to the accessory mounting system 200 via a magnetic coupling.

The mounting plate 270 also includes a second coupling mechanism 276. In an exemplary implementation, the second coupling mechanism 276 is a hook and loop fastener that aids in maintaining the first coupling mechanism 274 in the recess 272. The second coupling mechanism 276 is positioned to interact with a corresponding hook and loop fastener of an accessory, permitting the accessory to be removably mounted to the accessory mounting system 200 via a hook and loop coupling. The first coupling mechanism 274 and second coupling mechanism 276 can be used in combination and/or separately to couple and/or secure accessories to the accessory mounting system 200.

Referring back to FIGS. 5A and 5B, the adapter 210 is coupled to the first arm 56 of the wheelchair 56. The lock 250 is then translationally mounted to the attachment structure 230 of the adapter 210. The pair of protrusions 264 of the lock 250 engages one of the first plurality of apertures 234 and a corresponding one of the second plurality of apertures 238, thus securing the lock 250 to the adapter 210 and aiding in maintaining the flexible collar 220 in the closed position. Alternatively, the lock 250 may be configured to be mounted to the adapter 210 by a friction fit or the like.

The height of the lock 250 on the adapter 210 may be adjusted by engaging the pair of protrusions 264 with a different one of the first plurality of apertures 234 and a corresponding one of the second plurality of apertures 238. In some implementations, the first arm 56 of the wheelchair 50 is surrounded by a foam-like material to provide a cushion for the first arm 56. Over time, wear and tear to the foam-like material of the first wheelchair arm 56 may reduce the diameter of the first arm 56 such that the flexible collar 220 no longer firmly engages the first arm 56. Adjusting the height of the lock 250 relative to the adapter 210 by engaging a different corresponding set of the plurality of apertures 234, 238 narrows the gap 239. As the gap 239 narrows, the space between the first end 225 and second end 226 of the flexible collar 220 is reduced such that the diameter of the opening 228 is also reduced. Thus, the opening 228 of the flexible collar 220 may be adjusted to compensate for gradual changes to the size of the first arm 56 of the wheelchair 50, extending the functional life of the accessory mounting system 200.

Figure 9A:
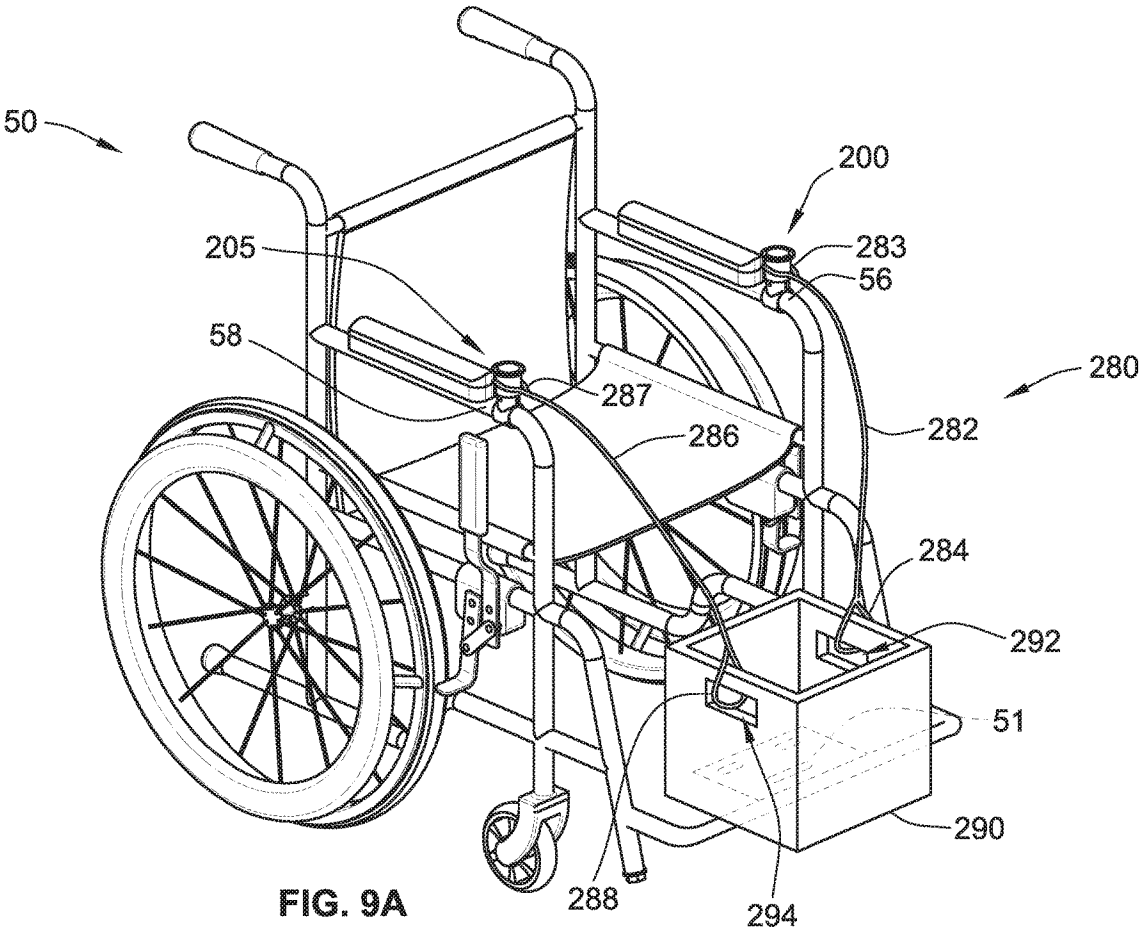
FIG. 9A is a perspective view of an accessory coupled to the wheelchair of FIG. 3 via a pair of the accessory mounting systems of FIG. 4.
Figure 9B:
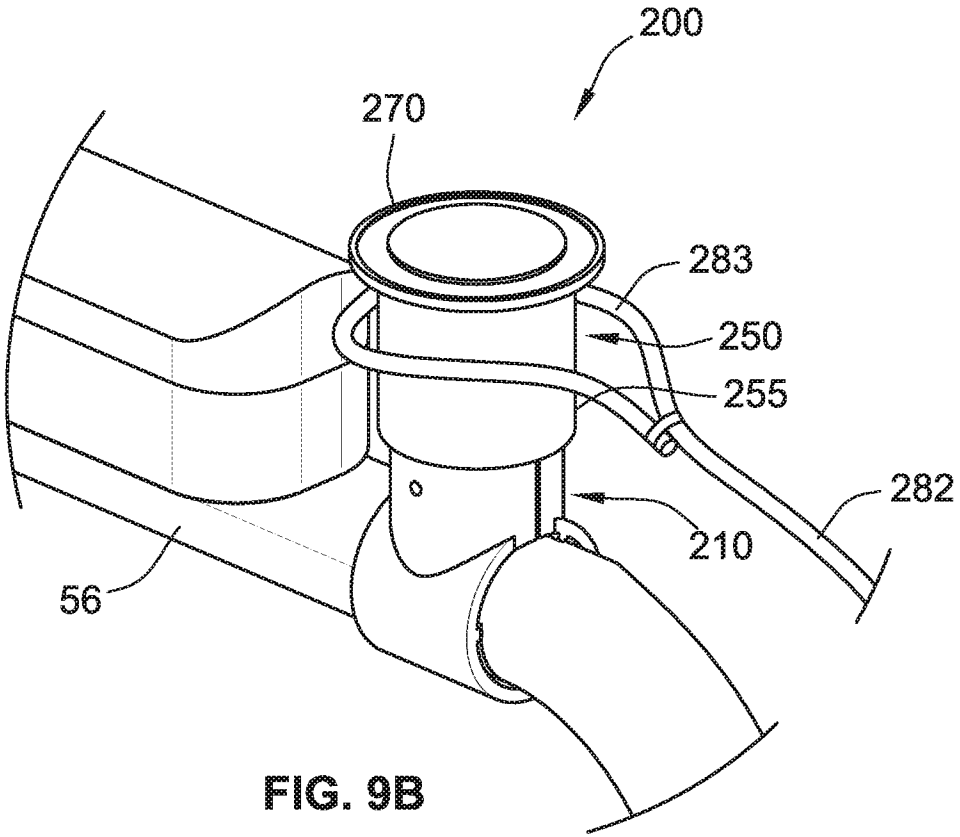
FIG. 9B is a perspective view of one of the accessory mounting systems of FIG. 9A and a portion of the accessory of FIG. 9A.

Generally referring to FIGS. 9A and 9B, an exemplary accessory 280 is attached to the wheelchair 50 via the accessory mounting system 200 and a second accessory mounting system 205. The accessory 280 includes a basket 290, a first flexible cable 282, and a second flexible cable 286. The first flexible cable 282 and the second flexible cable 286 may be rope, cable, wire, twine, or any other suitable material. The first flexible cable 282 has a first flexible loop 283 and a second flexible loop 284. The second flexible loop 284 of the first flexible cable 282 is configured to be coupled with a first handle 292 of the basket 290, thereby securing the basket 290 to the first flexible cable 282. The second flexible cable 286 has a first flexible loop 287 and a second flexible loop 288. The second flexible loop 288 of the second flexible cable 286 is configured to be coupled with a second handle 294 of the basket 290, thereby securing the basket 290 to the second flexible cable 286. By locating the basket 290 on the footrest 51, the user is able to conveniently access the contents of the basket 290 and the accessory mounting system 200 does not impede operation of the wheelchair 50.

As best shown in FIG. 9B, the first flexible loop 283 of the first flexible cable 282 is coupled to the lock 250 of the accessory mounting system 200. The first flexible loop 283 is generally sized such that it may fit over the lock 250 and is adjustable such that the first flexible loop 283 can be cinched to secure it to the lock 250. However, other possibilities for coupling the first flexible loop 283 to the lock 250 are contemplated, such as the first flexible loop 286 may be integral with the lock 250, the first flexible loop 286 may be an elastic material and sized such that it may be stretched over the lock 250, the first flexible loop 286 may be a magnetic material with a magnet mounted on the mounting platform 270, a hook and loop fastener system, a welded connection, or the first flexible loop may be coupled to a hook extending from the mounting platform 270. The first flexible loop 287 of the second flexible cable 286 is similarly coupled with the second accessory mounting system 205 (FIG. 9A) that is the same as the accessory mounting system 200.

Figure 10:
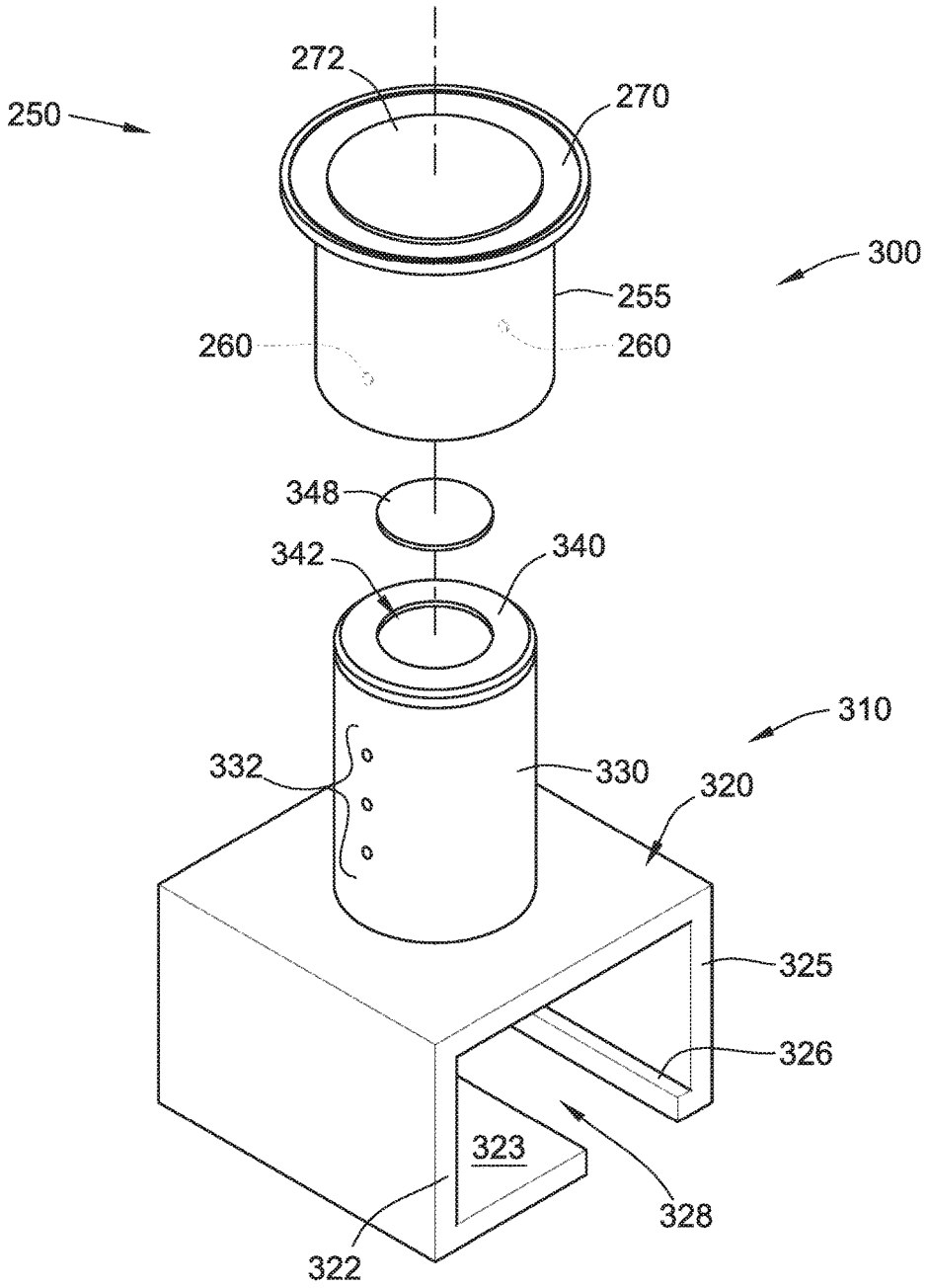
FIG. 10 is a partially exploded perspective view of an accessory mounting system according to some implementations of the present disclosure.

Referring to FIG. 10, an accessory mounting system 300 includes an adapter 310 and the lock 250. The adapter 310 is similar to the adapter 210 in that it includes a flexible collar 320 and an attachment structure 330. The flexible collar 320 differs from the flexible collar 220 of the accessory mounting system 200 in that the flexible collar 320 has a generally rectangular configuration for coupling with a differently shaped arm of a wheelchair as compared with the first arm 56 of the wheelchair 50. The flexible collar 320 has a first arm 322 and a second arm 325. As shown, the flexible collar 320 defines an opening 328. The first arm 322 has an inner surface 323 and the second arm 325 has an inner surface 326. The inner surface 323 of the first arm 322 and the inner surface of the second arm 325 are configured to engage an arm (not shown) of a wheelchair to secure the adapter 310 to the wheelchair.

The attachment structure 330 is similar to the attachment structure 230 (FIG. 6A) in that the attachment structure 330 includes a first plurality of apertures 332, a second plurality of apertures (not shown), and a plate 340 having a recess 342. The first plurality of apertures 332 and second plurality of apertures are configured to engage the pair of protrusions 260 of the lock 250. The attachment structure 330 differs from the attachment structure 230 (FIG. 6A) in that the attachment structure 330 does not include a pair of moveable arms.

While the lock 250 of the present disclosure is configured to engage the adapter 210 and the adapter 310, the lock 250 can also be coupled with the widened portion 36 (FIG. 2) of the second hollow member 30 of the accessory mounting system 1 described above. In such implementations, the widened portion 36 can be modified to include a first plurality of apertures and a second plurality of apertures in the same, or similar manner as the adapter 210. Thus, the lock 250 may engage the widened portion 36 of the second hollow member 30 in the same, or similar, manner that the lock 250 engages the attachment structure 230 of the adapter 210. In such implementations, the first coupling mechanism 274 and the second coupling mechanism 276 may be used to removably mount accessories to the system shown in FIG. 2 in the same, or similar, manner as accessories are mounted to the accessory mounting systems 200, 300.

Referring generally to FIGS. 11-13B, a canopy system 400 mounted to the wheelchair 50 includes a pair of adapters 210, a pair of locks 415, 417, and a canopy 496. As shown in FIG. 12B, the lock 415 (which is the same as the lock 417)

is similar to the lock 250 (FIG. 8B) of the accessory mounting system 200 in that the lock 415 includes a body 420 which has a pair of protrusions 426 (FIG. 12B) that engage the adapter 210. The lock 415 is different than the lock 250 in that the lock 415 includes a gear assembly 430 instead of a mounting platform 270. The canopy 496 may be canvas, plastic, vinyl, or any other suitable material. The material may also be rigid, flexible, waterproof, or UV resistant.

Figure 12B:
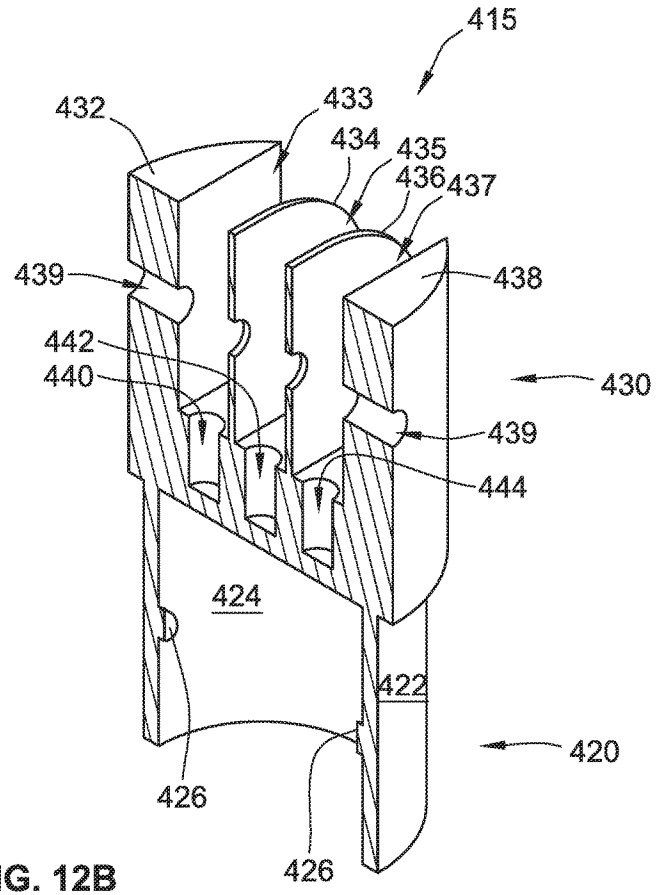
FIG. 12B is a partial cross-sectional perspective view of the lock of FIG. 12A.
Figure 12A:
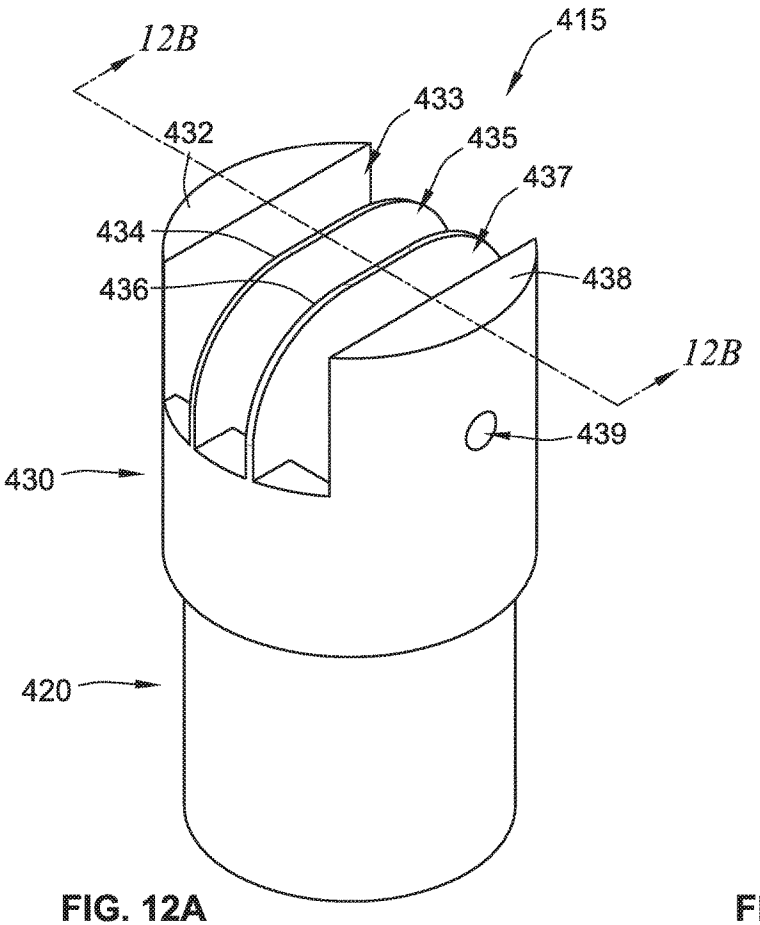
FIG. 12A is a perspective view of a lock of the canopy support system of FIG. 11 with a portion of a gear assembly removed for illustrative purposes.

FIG. 12A is a perspective view of the lock 415 with the internal components of the gear assembly 430 removed for illustrative purposes. The gear assembly 430 includes a first arm 432, a first divider 434, a second divider 436, a second arm 438, and a central aperture 439. The first arm 432 and the first divider 434 define a first gear slot 433, the first divider 434 and the second divider 436 define a second gear slot 435, and the second divider 436 and the second arm 438 define a third gear slot 437.

As best shown in FIG. 12B, the first gear slot 433 includes a first recess 440, the second gear slot 435 includes a second recess 442, and the third gear slot 437 includes a third recess 446. Further, the central aperture 439 extends through the gear assembly 430 from the first arm 432 to the second arm 438.

Figure 13B:
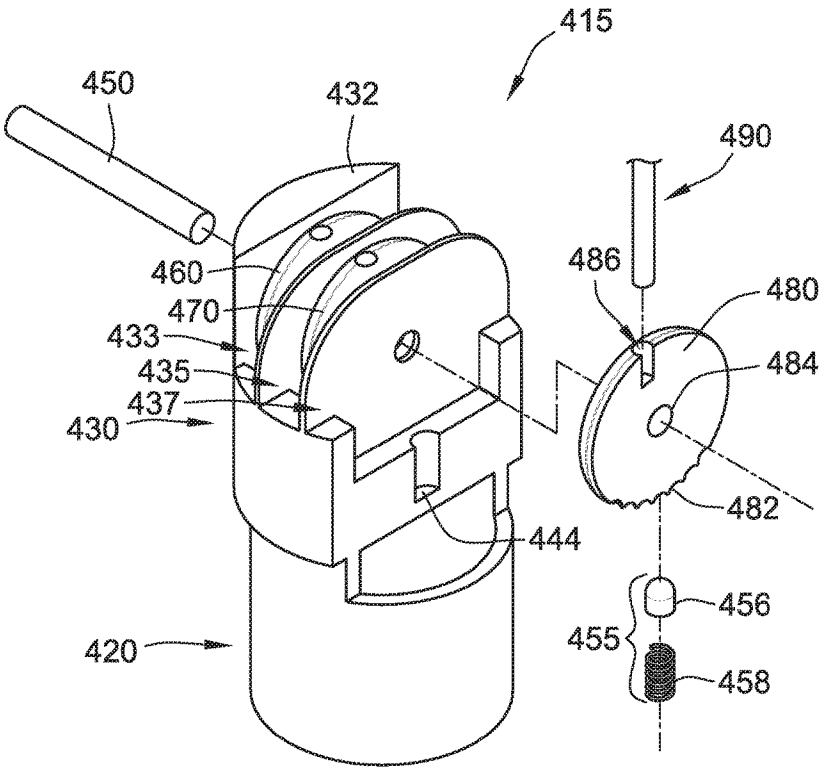
FIG. 13B is a partially exploded perspective view of the lock of FIG. 13A.
Figure 13A:
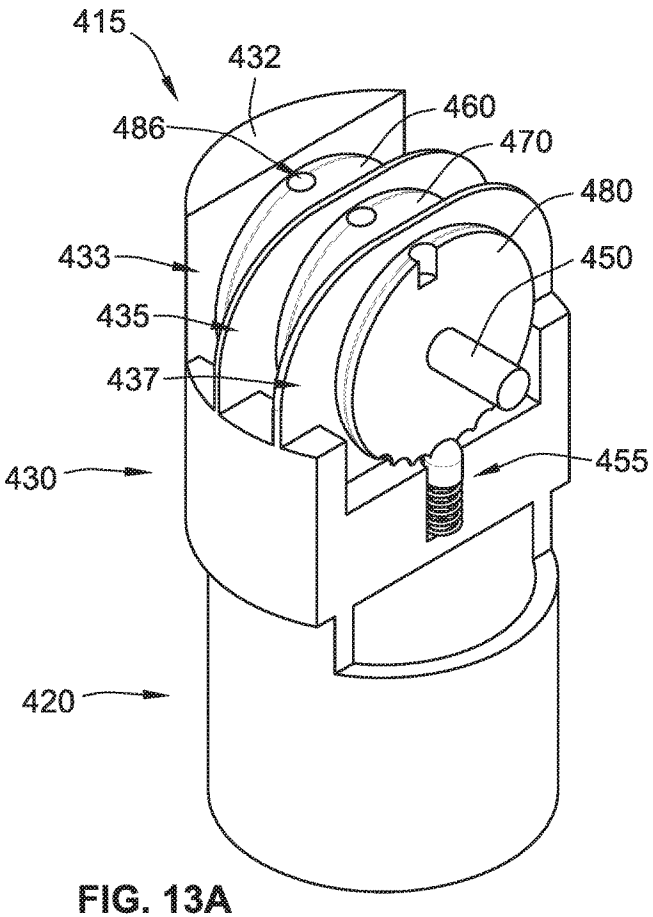
FIG. 13A is a partial perspective view of the lock of FIG. 12A including a number of elements of the gear assembly therein.

As best shown in FIGS. 13A and 13B, the third gear slot 437 includes a gear locking mechanism 455, a recess 444, and a gear 480. The gear locking mechanism 455 includes a pin 456 and a spring 458. In some implementations, the pin 456 has a diameter of about fifty-five millimeters and a length of about ten millimeters. The recess 444 is configured to receive the gear locking mechanism 455, with the spring 458 being generally disposed within the recess 444 and the pin 456 protruding therefrom. The third gear 480 includes a third plurality of teeth 482, a third aperture 484, and a third support lock 486. In some implementations, the third gear 480 has a diameter of about thirty millimeters. The third plurality of teeth 482 are configured to engage the pin 456 of the gear locking mechanism 455. The central aperture 439 is configured to receive an axel 450 therethrough such that the third gear 480 is rotatable with respect to the axel 450. In some implementations, the axel 450 has a diameter of about five millimeters and a length of about thirty millimeters. The second gear slot 435 and the first gear slot 433 are the same as the third gear slot 437. As shown, each gear slot encases a respective gear of the gear assembly 430, which prevents interference with the operation of the other ones of the gears and prevents user appendages from being pinched in the gears. As shown, the gear assembly 430 includes three gears. Alternatively, the gear assembly 430 can include any number of gears, such as, for example, a single gear, two gears, five gears, etc.

Figure 11:
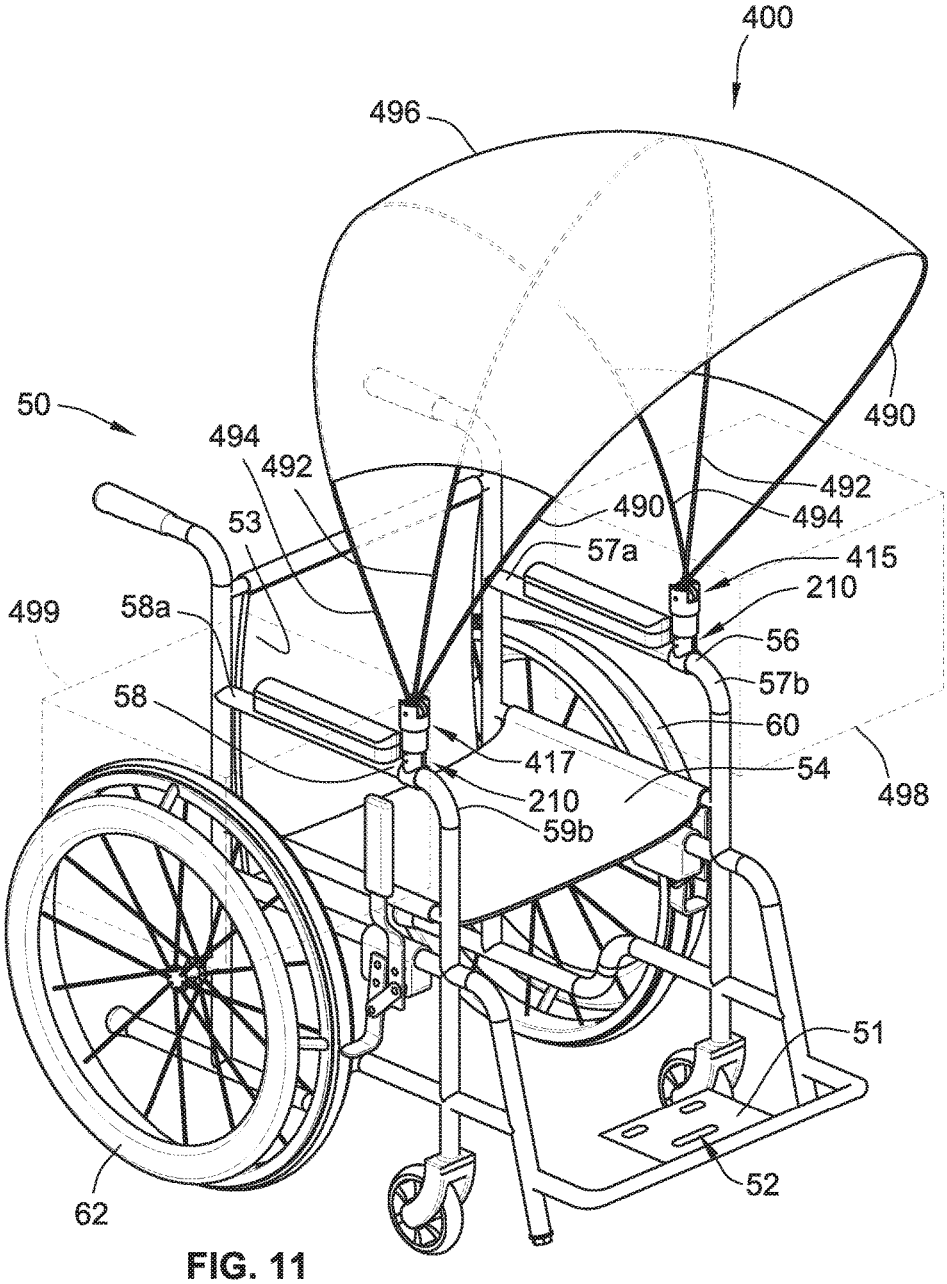
FIG. 11 is a perspective view of a canopy support system coupled to a wheelchair according to some implementations of the present disclosure.

As shown in FIG. 11, the canopy system 400 includes the second adapter 210 and the second lock 417 coupled to a second arm 58 of the wheelchair 50. The second adapter 210 and the second lock 417 are the same as the first adapter 210 and the first lock 415. As illustrated, the first adapter 210 is coupled to a distal portion 57*b* of the first arm 56 and the second adapter 210 is coupled to a distal portion 59*b* of the second arm 58. Coupling the first adapter 210 at the distal portion 57*b* defines a space 498 between the first adapter 210 and a back 52 of the wheelchair 50. The space 498 provides the user of the wheelchair 50 direct access to the first rear wheel 60 during operation of the wheelchair 50. A second space 499 provides the user of the wheelchair 50 direct access to the second rear wheel 62. Advantageously, the spaces 498, 499 permit the user of the wheelchair 50 to fully operate the wheelchair 50 while the canopy system 400 is deployed without being impeded by the canopy system 400. Further, the spaces 498, 499 provide the user of the wheelchair 50 direct access to the canopy system 400, facilitating full control of the canopy system 400 when the user is operating the wheelchair 50.

As shown in FIG. 11, the canopy system 400 includes a first canopy support 494, a second canopy support 492, and a third canopy support 490. In some implementations, each of the canopy supports 490, 492, 494 has a diameter of about five millimeters and a length of about five-hundred millimeters. Each canopy support 490, 492, 494 is coupled to the canopy 496 to support the canopy 496. To couple a canopy support, the canopy 496 may contain a plurality of channels configured to receive a canopy support, or a hook and fastener system for removably coupling a canopy support. Referring to FIG. 13B, the third support lock 486 of the third gear 480 is configured to receive the first canopy support 490, thus securing the third canopy support 490 to the third gear 480. However, other possibilities for coupling the third canopy support 490 to the third gear 480 are contemplated, such as the third canopy support 490 being integral with the gear 480, a threaded connection, a welded connection, or a locking collar. Alternatively still, the third canopy support 490 may be removable with respect to third gear 480 such that the canopy system 400 can be easily stored. The first canopy support 494 and the second canopy support 492 are coupled in the same manner to the first gear 460 and the second gear 470, respectively.

The canopy supports 490, 492, 494 are each pivotal with respect to the body of the lock 415 such that the user of the wheelchair 50 can selectively deploy and retract the canopy 496 by moving the canopy supports 490, 492, 494. Movement of the canopy supports 490, 492, 494 is co-extensive with the movement of the corresponding gears 460, 470, 480. For example, referring to the third gear 480, the third spring 458 of the third gear locking mechanism 455 urges the pin 456 to engage the plurality of teeth 482 of the third gear 480 and aids in maintaining the third canopy support 490 in a desired position. Moving the third canopy support 490 to a second desired position causes the third gear 480 to rotate relative to the axel 450 and compress the spring 458 such that the plurality of teeth 482 and pin 456 disengage. When the second desired position is achieved, the spring 458 expands and urges the pin 456 to engage the plurality of teeth 482 and maintains the third canopy support 490 in the second desired position. Operation of the first canopy support 494 and the second canopy support 492 is the same as the operation the third canopy support 490. Thus, the user is permitted to adjust the shading or cover provided by the canopy 496 by moving any of the first canopy support 494, the second canopy support 492, or the third canopy support 490 as required by the elements.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the invention. It is also contemplated that additional embodiments according to aspects of the present invention may combine any number of features from any of the embodiments described herein.

What is claimed:

1. A system for removably mounting accessories to a wheelchair, the system comprising:

an adapter including a flexible collar and an attachment structure, the flexible collar being configured to move between an open position and a closed position, the flexible collar being configured to at least partially surround a portion of the wheelchair such that the flexible collar engages the portion of the wheelchair and aids in preventing rotation of the adapter relative to the portion of the wheelchair, the attachment structure having (i) a first arm attached to and extending from the flexible collar and having a first end and an opposing second end, (ii) a second arm attached to and extending from the flexible collar and having a first end and an opposing second end, and (iii) a plate having a recess configured to receive a first magnet therein; and a lock including a body and a mounting platform attached thereto, the body of the lock being configured to engage the attachment structure of the adapter to aid in maintaining the flexible collar in the closed position, the mounting platform having one or more coupling mechanisms attached thereto for use in removably mounting one or more of the accessories to the system, the one or more coupling mechanisms include a second magnet and a hook and loop fastener, the second magnet being received in a recess of the mounting platform and being configured to interact with the first magnet to aid in securing the lock to the attachment structure, the hook and loop fastener being configured to maintain the second magnet in the recess of the mounting platform.

2. The system of claim 1, wherein the flexible collar has a generally curved configuration in the closed position.

3. The system of claim 1, wherein the collar has a first end and a second end and responsive to the flexible collar being in the closed position, the first end of the flexible collar is directly adjacent to the second end of the flexible collar and responsive to the flexible collar being in the open position, the first end of the flexible collar is spaced from the second end of the flexible collar.

4. The system of claim 1, responsive to the flexible collar being in the closed position, the flexible collar defines an opening and wherein the flexible collar includes a plurality of ridges protruding from an inner surface into the opening.

5. The system of claim 4, wherein the plurality of ridges directly engage the portion of the wheelchair and aid in preventing rotation of the flexible collar relative to the portion of the wheelchair.

6. The system of claim 1, wherein the first end of the first arm is directly attached to the first end of the flexible collar and the second end of the first arm is directly attached to the plate such that the first arm is not moveable with respect to the plate, and wherein the first end of the second arm is directly attached to the second end of the flexible collar and the second end of the second arm is detached from the plate such that the second arm is moveable with respect to the plate.

7. The system of claim 1, wherein the first arm of the attachment structure has a first plurality of apertures and the second arm of the attachment structure has a second plurality of apertures.

8. The system of claim 7, wherein the body of the lock has a pair of inwardly extending protrusions that is configured to engage one of the first plurality of apertures and a corresponding one of the second plurality of apertures in response to the lock engaging the attachment structure.

9. The system of claim 8, wherein the first plurality of apertures includes at least three apertures and the second plurality of apertures includes at least three apertures.

10. The system of claim 1, wherein the flexible collar has a diameter of about 33 millimeters.

11. The system of claim 1, wherein the flexible collar comprises a polymer material.

12. The system of claim 1, wherein the attachment structure has a generally cylindrical configuration.

13. The system of claim 1, wherein the recess of the attachment structure has a generally cylindrical configuration.

14. The system of claim 1, wherein the first arm and the plate are monolithic.

15. The system of claim 1, wherein the mounting platform has a generally cylindrical configuration.

16. The system of claim 1, wherein the one or more accessories include a mobile phone holder, a tray, a cup, a cup-holder, a tablet-holder, a camera-holder, or any combination thereof.

17. The system of claim 1, wherein the portion of the wheelchair is an arm of the wheelchair.

18. The system of claim 1, wherein the portion of the wheelchair is a distal portion of an arm of the wheelchair.

* * * * *